US007810198B2

(12) United States Patent
Sahr et al.

(10) Patent No.: US 7,810,198 B2
(45) Date of Patent: Oct. 12, 2010

(54) WHEELCHAIR LIFT APPARATUS

(75) Inventors: Christian Sahr, Calden (DE); Alexander Heckel, Schwalmastadt (DE)

(73) Assignee: Huber Transportation GmbH, Kassel (DE)

( * ) Notice: Subject to any disclaimer, the term of this patent is extended or adjusted under 35 U.S.C. 154(b) by 160 days.

(21) Appl. No.: 12/231,460

(22) Filed: Sep. 3, 2008

(65) Prior Publication Data

US 2009/0151094 A1 Jun. 18, 2009

(30) Foreign Application Priority Data

Dec. 12, 2007 (DE) ..... 10 2007 059 943

(51) Int. Cl.
*E01D 1/00* (2006.01)
*B60P 1/02* (2006.01)

(52) U.S. Cl. ..... 14/69.5; 414/540; 414/541

(58) Field of Classification Search ..... 14/69.5–72.5; 414/540, 541

See application file for complete search history.

(56) References Cited

U.S. PATENT DOCUMENTS 4,219,104 A * 8/1980 MacLeod ..... 414/540
5,040,936 A * 8/1991 Rhea ..... 414/540
6,039,528 A * 3/2000 Cohn ..... 414/546
6,102,648 A * 8/2000 Fretwell et al. ..... 414/540
6,179,545 B1 * 1/2001 Petersen et al. ..... 414/537
2004/0228713 A1 * 11/2004 Cohn et al. ..... 414/546

FOREIGN PATENT DOCUMENTS

NL 1021891 11/2002
WO 94/27546 12/1994

* cited by examiner

*Primary Examiner*—Raymond W Addie
(74) *Attorney, Agent, or Firm*—Thomas R. Vigil

(57) ABSTRACT

The present invention is directed to a wheelchair lift apparatus (1) for mounting to a vehicle, e.g., to a bus or a railway car, comprising a platform (2) having a bridge plate (3) pivotally hinged thereon, said platform (2) being retained by at least one carriage (5), said carriage (5) being carried for travel into and out of a housing (50) of the vehicle, said carriage (5) with the platform (2) being connected by two hinge arms (4) disposed on either side of the platform, said carriage (5) comprising at least one drive (6) for connection to the hinge arms (4), said bridge plate being pivotally carried in the platform (2) through a pivot axis (20), a push rod linkage (10), which is positively coupled at one end to the at least one hinge arm (4) and which is connected for rotation of the pivot axis (20) to the pivot axis (20) of the bridge plate (3) at the other end being provided, a limit stop (30) acting onto the pivot axis (20) being provided, said limit stop being spring-loaded for the bridge plate (3) to be swung open by the spring-loaded limit stop when the ramp platform is deployed.

5 Claims, 5 Drawing Sheets

WHEELCHAIR LIFT APPARATUS

CROSS-REFERENCE TO RELATED APPLICATIONS

This application claims Priority from German Application No. DE 10 2007 059 943.0 filed on 12 Dec. 2007

FIELD OF THE INVENTION

The present invention relates to a wheelchair lift apparatus for mounting to a vehicle, e.g., to a bus or a railway car, comprising a platform having a bridge plate pivotally hinged thereon, said platform being retained by at least one carriage, said carriage being carried for travel into and out of a housing of the vehicle, said carriage with the platform being connected by two hinge arms disposed on either side of the platform, said carriage comprising at least one drive for connection to the hinge arms, said bridge plate being pivotally carried on the platform through a pivot axis, a pusher housing, which is positively coupled at one end to the at least one hinge arm and which is connected for rotation of the pivot axis to the pivot axis of the bridge plate at the other end being provided.

DESCRIPTION OF THE PRIOR ART

This Dutch patent document 1021891 is directed to what is referred to as a wheelchair lift apparatus as it is mounted to vehicles, in particular to busses, in order to allow wheelchair users to board the bus. For this purpose, a housing is provided on the car body, said housing accommodating a carriage which most of the time is adapted to be moved out of the housing across the longitudinal axis of the vehicle, the platform being hinged to the carriage with two parallely extending hinge arms. Through the hinge arms, the platform can be lowered or raised with the help of a drive, more specifically with the help of at least one piston and cylinder drive that is disposed in the carriage and acts onto a tie bar connecting the two hinge arms.

Boarding a bus or a railway car is by climbing steps. The platform is raised in the vertical direction only so that there is still a gap to be bridged between the end of the platform and the floor of a bus for example, which is due to the steps. The so-called bridge plate serves this purpose.

As already mentioned above, there is provided a drive that causes the carriage to which the bridge plate is hinged to move in or out.

Another drive is needed to cause the hinge arms to raise or lower the bridge plate. According to the prior art mentioned above, the Dutch Patent 1021891, another drive is needed to pivot said bridge plate. More precisely, there is provided a piston and cylinder drive therefor, said piston and cylinder drive being affixed off center to the pivot axis of the bridge plate, thus causing the bridge plate to move from a horizontal position in the retracted position of the platform via a vertical position back into a horizontal position.

The previously described wheelchair lift apparatus has proved efficient in daily use. However, it is quite expensive, which is in particular due to the fact that there are provided at least five drives for the platform, the bridge plate and the carriage to be capable of executing the movements they are intended to perform. One drive is provided for moving the carriage out, two parallel acting piston and cylinder drives are provided to lower and raise the platform and two piston and cylinder drives are provided to pivot the bridge plate.

A wheelchair lift apparatus of the type mentioned herein above is known from WO 94/27546, wherein there is also provided a bridge plate. This bridge plate is pivotally carried in the frame of the ramp platform. The bridge plate is connected through the pivot lever and the rod articulated thereto to the one hinge arm, which, in connection with a second hinge arm as a parallelogram element, finally makes sure that the platform is raised. This means that the bridge plate is positively controlled by the pivot lever and the rod in connection with the hinge arm with respect to the pivotal movement of the bridge plate. Especially when the platform is brought into a position relative to the vehicle that makes it possible to retract the ramp platform, the bridge plate is brought into a position pointing slightly diagonally away from the ramp platform as can be seen in FIG. 2 of the cited document. In the position shown in FIG. 2, the platform is retracted. When the platform is lowered, by contrast, the bridge plate is brought into a vertical position. Since the height of the mounting enclosure in the vehicle floor, which accommodates the ramp platform, is quite low, the bridge plate also can only have a quite low height in the inclined position. Otherwise, the platform could not be retracted. This is particularly relevant if, to bridge the gap from the rear edge of the ramp platform to the vehicle floor, a bridge plate of greater length is needed as it is the case for example when not only one stair step must be bridged but when, as it is often the case, the gap is due to two or three stair steps. With a construction according to the cited document, such gaps can no longer be bridged or such a ramp platform with the bridge plate being slightly pivoted away could no longer be retracted into the mounting enclosure of the vehicle because the bridge plate is much too long, thus protruding from the mounting enclosure.

Moreover, it must be made certain that immediately after the ramp platform has been deployed, the persons in the bus are prevented from stepping onto the ramp platform. It must also be made certain that the wheelchair user will not be capable of rolling off the ramp platform before the ramp platform, which is being raised, reaches its end position in which the wheelchair user can get inboard. This means that in the very moment the ramp platform is deployed from the mounting enclosure in the floor of the vehicle, the bridge plate must stand upright in order to prevent, as already explained, persons from stepping from the vehicle onto the extracted ramp platform and it must be further made certain that, when a wheelchair user is on the ramp platform, he is secured against rolling off; this occurs by placing the bridge plate upright on at least one side of the ramp platform.

BRIEF SUMMARY OF THE INVENTION

Accordingly, it is the object of the invention to provide a wheelchair lift apparatus of the type mentioned herein above that allows for bridging larger gaps between the rear edge of the ramp platform and the vehicle floor on the one side, as this is for example the case if the access to the vehicle incorporates several stair steps, whilst still allowing for the ramp platform to be retracted into the housing in the vehicle floor together with the bridge plate, and that ensures, on the other side, that the bridge plate stands upright immediately after the ramp platform has been moved out of the mounting enclosure in the vehicle floor and only folds down when the ramp platform has reached the end position needed for the wheelchair user to roll off.

In accordance with the invention, this object is achieved in that a limit stop is provided, which acts onto the pivot axis and which is spring-loaded for the bridge plate to be swung open by the spring-loaded limit stop when the ramp platform is deployed.

Advantageous features are recited in the dependent claims.

In this context, there is particularly provided that the push rod linkage assembly includes a fork arm, said fork arm comprising at its end a fork that is shape-matingly hinged to the at least one hinge arm. The fork of the fork arm takes hold of a pin that is disposed on the hinge arm; said pin is received for rotation by the fork. Through the movement of the hinge arm while the platform is being raised or lowered, the fork arm, which is pivotally carried on the platform, is moved in the horizontal direction, i.e., parallel to the depth or length of the platform. A push rod adjoins the fork arm, said push rod being connected to the pivot axis of the bridge plate or being engaged therewith. The push rod is engaged with the pivot axis of the bridge plate insofar for example as the pivot axis comprises a cam that cooperates with the push rod without a material-to-material bond having to be provided. If one assumes that the platform is deployed, i.e., that the platform rests on the floor, and if one further assumes that the platform is raised from this lower position, the angle of the hinge arms with respect to the platform will change in the fashion of a parallelogram element when the platform is being raised by the hinge arms. This results in a change in the position of the fork of the fork arm relative to the hinge arm, this simultaneously causing the push rod, which is connected to the hinge arm, to be displaced. This means that the push rod will move toward the pivot axis of the bridge plate or away therefrom.

As already explained, the pivot axis has an erecting cam, said erecting cam abutting the end of the push rod when the platform is being raised; when the platform is raised further, the bridge plate folds backward subject to the position of the platform, thus allowing the wheelchair user to board the vehicle, the bus for example. It is in this context that the so-called limit stop is provided, which acts onto the pivot axis of the bridge plate. As mentioned, this limit stop is spring-loaded, an abutment cam for the limit stop being provided on the pivot axis, said limit stop incorporating an abutment rod which, upon rotation of the pivot axis, is displaceable against the force of the spring by the abutment cam disposed on the pivot axis. This means that, in the retracted condition of the platform, condition in which the bridge plate rests on the platform, the bridge plate rises by virtue of the spring-loaded limit stop acting on the abutment cam immediately after the platform has been deployed with the help of the already mentioned carriage and adopts a position substantially perpendicular to the platform in which it then remains. In this condition, the platform cannot pivot off backward since the push rod abuts the erecting cam of the pivot axis of the bridge plate, thus preventing the bridge plate from pivoting open over more than approximately 90° when the platform has been put down. It is obvious therefrom that the push rod blocks the pivot axis through the erecting cam. If the platform is then raised, the bridge plate is caused to swing out beyond 90° degrees as far as 180° degrees maximum, this being the position the bridge plate reaches when the platform is level with the vehicle floor.

The invention will be discussed in closer detail herein after by way of example with reference to the drawings.

DETAILED DESCRIPTION OF THE INVENTION

Figure 1:
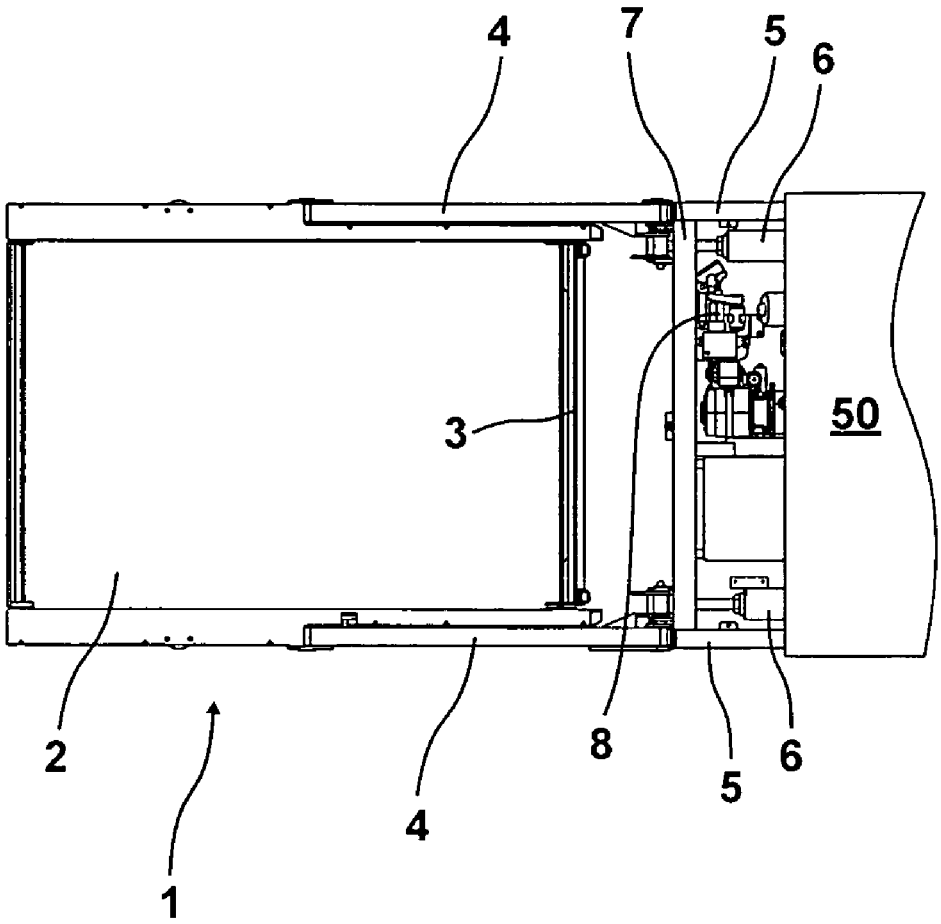
FIG. 1 shows the platform in a view from the top in a schematic illustration.
Figure 3:
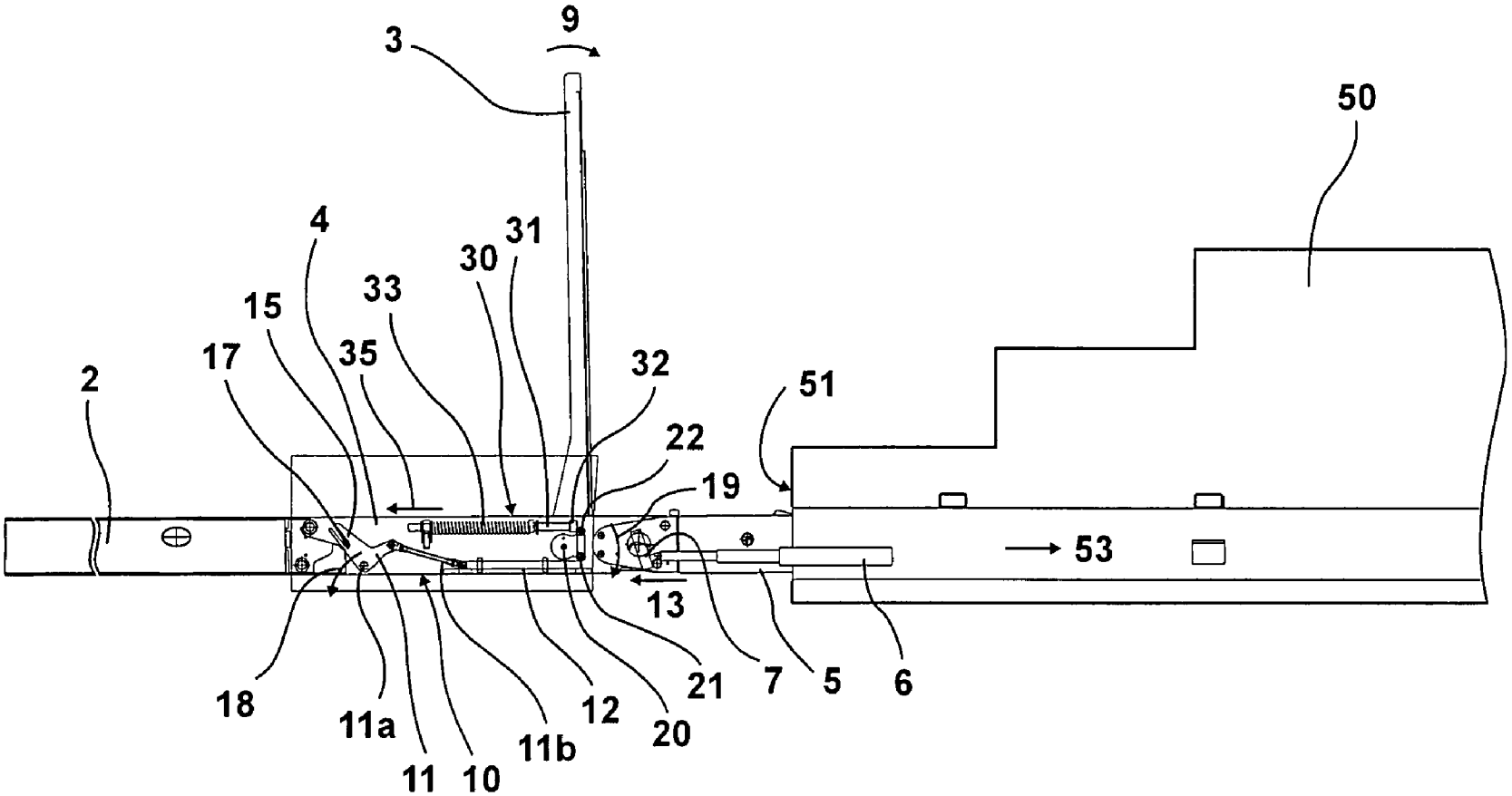
FIG. 3 shows a position in which the platform is located approximately on the level of the carriage.
Figure 4:
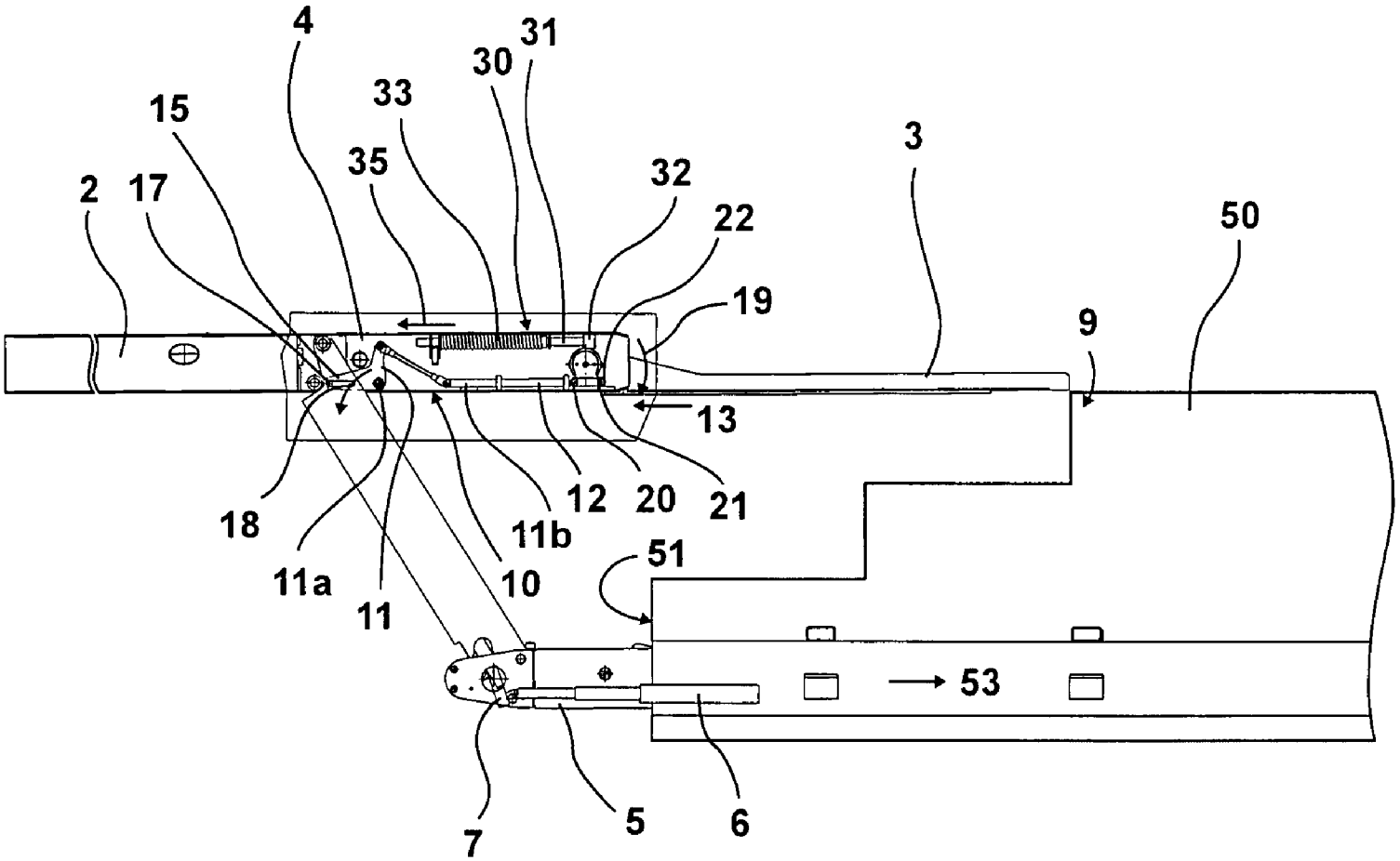
FIG. 4 shows a position in which the platform is located on the height of the vehicle floor.

According to FIG. 1, the lift apparatus indicated at 1 comprises the platform 2 which pivotally receives the bridge plate indicated at 3. FIG. 1 also shows the two hinge arms 4 (FIG. 2 and followings), which are arranged on the platform 2 on the one side and which are hinge-linked to the carriage indicated generally at 5 on the other side. The carriage 5 further has the two piston and cylinder drives 6 which are affixed to a tie bar 7 connecting the two hinge arms 4 and which ensure that the platform is put down (FIG. 2) or raised, as can be seen from the FIGS. 3 and 4. To move the carriage into the housing of the bus, there is provided the drive 8.

The subject matter of the actual invention now is the positive control of the bridge plate by the push rod linkage 10. Said push rod linkage 10 incorporates a fork arm 11 that is pivotally carried on the platform 2 through an axis 11*a*. The fork arm 11 comprises the push rod 12 at its one end, an intermediate member 11*b* being interposed therein between. The push rod 12 is carried on the platform for axial movement pursuant to the arrow 13. At its upper end, the fork arm 11*a* comprises the fork 15, a pin 17, which is affixed to the hinge arm 4 being rotatably carried in the fork 15.

If one considers now the pivot axis 20 for receiving the bridge plate 3, it appears that the pivot axis 20 comprises at its one, lower end in the mounted condition, an erecting cam 21 and at its other upper end an abutment cam 22. The erecting cam 21 cooperates with the push rod 12; above the push rod 12 there is the limit stop indicated generally at 30. The limit stop 30 incorporates an abutment rod 31 that is displaceable against the force of the spring 33 pursuant to the arrow 35. At its end, the abutment rod 31 comprises an abutment head 32 that cooperates with the abutment cam 22.

Figure 2:
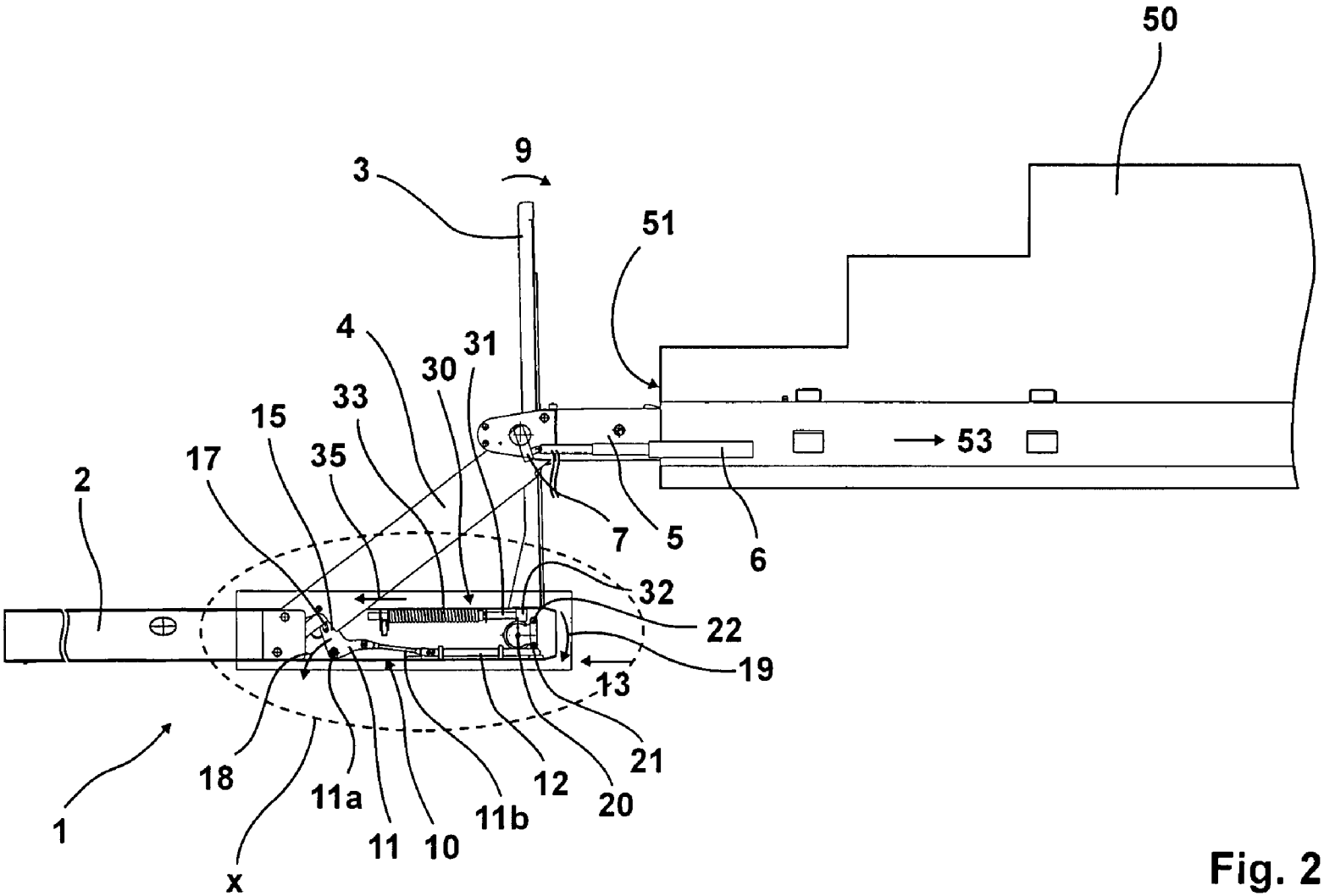
FIG. 2 shows a side view, with the platform being put down.
Figure 2A:
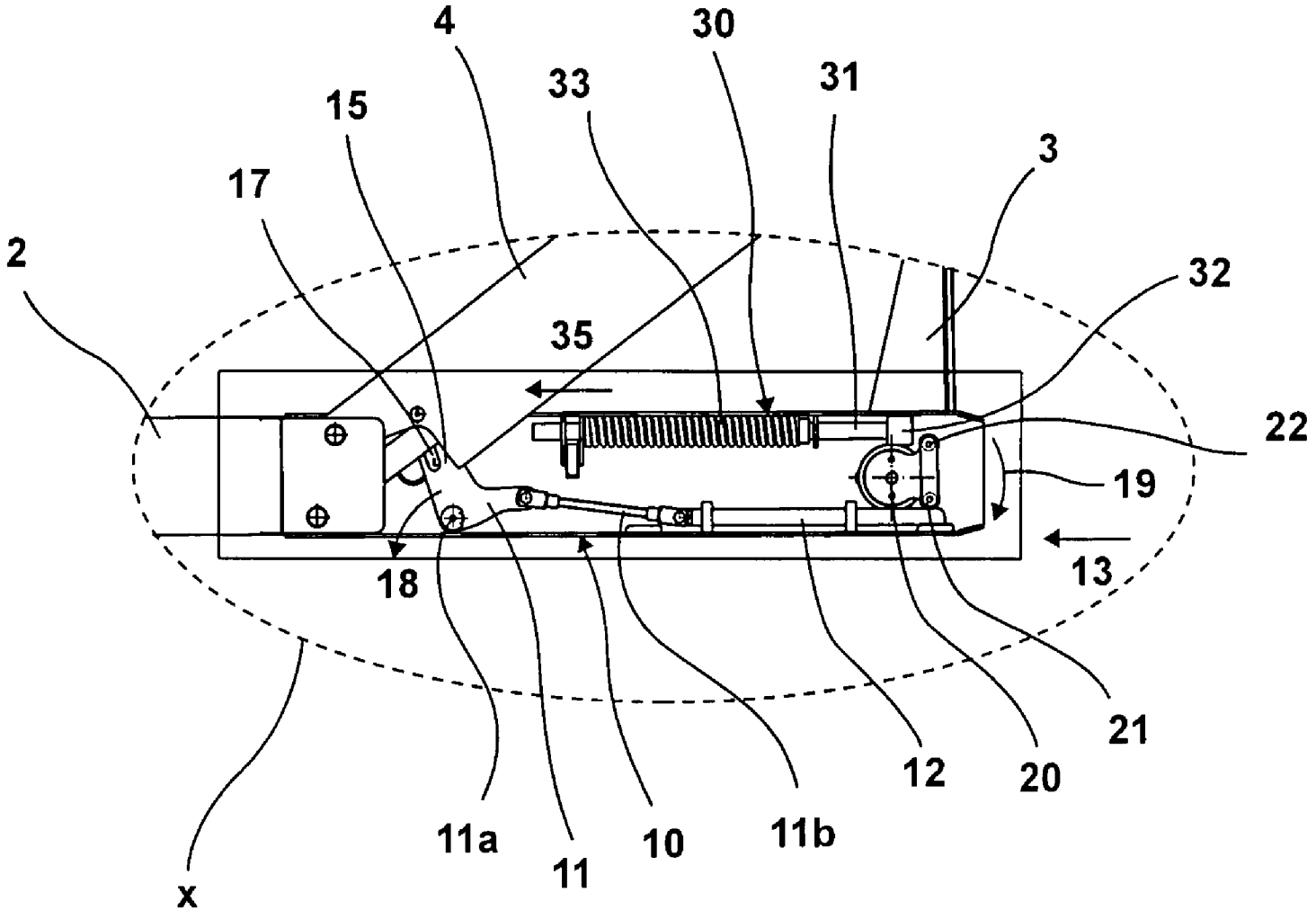
FIG. 2*a* shows the detail X of FIG. 2 to a larger scale.

In view of FIG. 2 or of FIG. 2*a*, the functioning of the lift apparatus is as follows with respect to the push rod linkage 10: In the condition shown in FIG. 2, the platform indicated at 2 is located for example on the floor and makes it possible for the wheelchair user to roll onto the platform. Now, with the help of the piston and cylinder drive 6, which is hinged to the tie bar 7 connecting the two hinge arms 4, the platform 3 is caused to pass through a position shown in FIG. 3 to the position shown in FIG. 4. When the platform 2 is being raised, the hinge arms 4 change their position relative to the platform 2. As already explained, the pin 17, which is disposed on the hinge arm 4, and the fork 15 of the fork arm 11 allow for a connection with the push rod 12. When the platform 2 is being raised, the fork 15 moves about the axis 11*a*, pursuant to arrow 18. The push rod is then pulled from the position shown in FIG. 2 toward the platform 2. In the position shown in FIG. 2, the pivot axis 20 is blocked insofar as the pivot axis 20 rests with its erecting cam 21 on the push rod 12 as this is obvious when reviewing FIG. 2*a*. If now—as already explained—the push rod 12 is pulled toward the platform, the pivot axis 20 rotates together with the erecting cam 21, which abuts the front side of the push rod 12, pursuant to arrow 19. This makes it possible for the bridge plate to pivot in the direction of the arrow 9, the bridge plate adopting a position shown in FIG. 4 in the end position, thus making it possible for the wheelchair user to board the bus from the platform 2.

Now, the lift apparatus is no longer needed and it must be retracted into the housing 50 in the car body of the bus. For this purpose, the platform is caused to move into a position shown in FIG. 3. The carriage 5 then retracts the platform 2 pursuant to arrow 53, with the platform 3 being pivoted in a direction opposite to the arrow 9 when the bridge plate 3 strikes the front side 51 of the housing 50. The abutment head 32 of the abutment rod 31 is thereby displaced by the abutment cam 22 of the pivot axis 20 pursuant to arrow 35, with the spring 33 being compressed, meaning biased. This means that in the retracted condition of the platform the bridge plate 3 rests on the platform 2, the spring 33 of the limit stop 30 being biased. As soon as the platform has been deployed, the bridge plate will immediately rise in order to prevent persons waiting in the bus from stepping onto the lowering platform.

We claim:

1. A wheelchair lift apparatus (1) for mounting to a vehicle, e.g., to a bus or a railway car, comprising a platform (2) having a bridge plate (3) pivotally hinged thereon, said platform (2) being retained by at least one carriage (5), said carriage (5) being carried for travel into and out of a housing (50) of the vehicle, said carriage (5) with said platform (2) being connected by two hinge arms (4) disposed on either side of said platform, said carriage (5) comprising at least one drive (6) for connection to said hinge arms (4), said bridge plate being pivotally carried in said platform (2) through a pivot axis (20), a push rod linkage (10), which is positively coupled at one end to said at least one hinge arm (4) and which is connected for rotation of said pivot axis (20) to said pivot axis (20) of said bridge plate (3) at the other end being provided, characterized in that a limit stop (30) acting onto said pivot axis (20) is provided, said limit stop being spring-loaded for said bridge plate (3) to be swung open by said spring-loaded limit stop when the ramp platform is deployed.

2. The wheelchair lift apparatus as set forth in claim 1, characterized in that the push rod linkage (10) incorporates a fork arm (11), said fork arm (11) comprising at its end a fork (15) that is shape-matingly and rotatably connected with the at least one hinge arm (4).

3. The wheelchair lift apparatus as set forth in claim 1, characterized in that the fork arm (11) is pivotally carried on the platform (2).

4. The wheelchair lift apparatus as set forth in claim 1, characterized in that the hinge arm (4) comprises a push rod (12) and that the pivot axis (20) has an erecting cam (21) communicating with the push rod (12) for receiving the bridge plate (3).

5. The wheelchair lift apparatus as set forth in claim 1, characterized in that the limit stop (30) incorporates an abutment rod (31) that is displaceable against the force of a spring (33) by the abutment cam (22) disposed on the pivot axis (20) upon rotation of said pivot axis (20).

* * * * *

UNITED STATES PATENT AND TRADEMARK OFFICE

CERTIFICATE OF CORRECTION

PATENT NO. : 7,810,198 B2
APPLICATION NO. : 12/231460
DATED : October 12, 2010
INVENTOR(S) : Christian Sahr and Alexander Heckel It is certified that error appears in the above-identified patent and that said Letters Patent is hereby corrected as shown below:

On the Title Page:

Change: "(75) Inventors: Christian Sahr, Calden (DE);
Alexander Heckel, Schwalmastadt (DE)"

To: --(75) Inventors: Christian Sahr, Calden (DE);
Alexander Heckel, Schwalmstadt (DE)

Signed and Sealed this
Nineteenth Day of April, 2011

David J. Kappos

David J. Kappos
*Director of the United States Patent and Trademark Office*